US010669732B2

(12) United States Patent
Ellis et al.

(10) Patent No.: US 10,669,732 B2
(45) Date of Patent: Jun. 2, 2020

(54) WHEELED POOL CLEANER WITH REMOVABLE COVER

(71) Applicant: NC Brands L.P., Norwalk, CT (US)

(72) Inventors: Robin O. Ellis, Pine Ridge, FL (US); Paul Lambourn, Sydenham (ZA); Michael R. Tregoning, Edenvale (ZA)

(73) Assignee: NC BRANDS L.P., Norwalk, CT (US)

( * ) Notice: Subject to any disclaimer, the term of this patent is extended or adjusted under 35 U.S.C. 154(b) by 64 days.

(21) Appl. No.: 16/138,342

(22) Filed: Sep. 21, 2018

(65) Prior Publication Data

US 2019/0085580 A1 Mar. 21, 2019

Related U.S. Application Data

(60) Provisional application No. 62/561,325, filed on Sep. 21, 2017.

(51) Int. Cl.
*E04H 4/16* (2006.01)

(52) U.S. Cl.
CPC ..... *E04H 4/1654* (2013.01); *E04H 4/1636* (2013.01)

(58) Field of Classification Search
CPC ..... E04H 4/1654; E04H 4/1636; E04H 4/16
USPC ..... 15/1.7
See application file for complete search history.

(56) References Cited

U.S. PATENT DOCUMENTS 5,351,355 A 10/1994 Chiniara
6,854,148 B1 2/2005 Rief et al.
7,455,034 B2 11/2008 Didonato
9,885,194 B1 * 2/2018 Hayes ..... E04H 4/1654
2003/0177594 A1 9/2003 Van Der Meyden et al.
2003/0182742 A1 * 10/2003 Wichmann ..... E04H 4/1654 15/1.7
2007/0067930 A1 3/2007 Garti
2008/0099409 A1 5/2008 Gorelik et al.
2010/0306931 A1 12/2010 Garti
2010/0307545 A1 12/2010 Osaka et al.
2011/0000036 A1 * 1/2011 Pichon ..... E04H 4/1654 15/1.7
2016/0051913 A1 2/2016 Witelson et al.
2016/0060887 A1 * 3/2016 Tryber ..... E04H 4/1654 15/1.7

(Continued)

OTHER PUBLICATIONS

PCT International Searching Authority; International Search Report and Written Opinion dated Jan. 29, 2019; entire document.

*Primary Examiner* — Weilun Lo
(74) *Attorney, Agent, or Firm* — Merchant & Gould P.C.; Daniel R. Evans

(57) ABSTRACT

A pool cleaner includes a pool cleaner body and at least two wheels mounted to the pool cleaner body so as to be rotatable about a common wheel axis. An access cover selectively closing an access opening defined in the body. A handle closure is mounted to the body so as to be rotatable about the common wheel axis independently of the at least two wheels. The handle closure is rotatable relative to the body so as to be movable between a closed position, in which the handle closure secures the access cover over the access opening, and an open position. An inner cover can selectively cover a turbine and gears of the pool cleaner within the body, and is held in place via engagement with the access over. Wheel well sidewalls can be substantially solid to help further enclose an inner volume of the body.

26 Claims, 9 Drawing Sheets

(56) References Cited

U.S. PATENT DOCUMENTS

| | | | | |
|---|---|---|---|---|
| 2016/0153210 | A1* | 6/2016 | Sebor | E04H 4/1654<br>15/1.7 |
| 2018/0044936 | A1* | 2/2018 | Torem | E04H 4/1654 |
| 2019/0040642 | A1* | 2/2019 | Michelon | E04H 4/1654 |

* cited by examiner

WHEELED POOL CLEANER WITH REMOVABLE COVER

This application claims the benefit of U.S. Provisional Patent Application Ser. No. 62/561,325, filed on Sep. 21, 2017, the contents of which application are herein incorporated by reference in their entirety.

FIELD OF THE INVENTION

The present invention relates to pool cleaners, and more particularly to wheeled pool cleaners with removable covers.

BACKGROUND OF THE INVENTION

There are a wide variety of mechanical pool cleaners which are configured to move along underwater surfaces of a swimming pool while vacuuming dirt and debris therefrom. Several types of such cleaners are wheeled, traversing the pool surfaces on two or more wheels. In wheeled cleaners, the motive force to drive the cleaner is often supplied by power supplied to one or more of the wheels. This usually involves a water-driven turbine, although pool cleaners with electric motors are also known. Normally, and particularly in water turbine-driven cleaners, the wheels receive power via multiple gears—which can serve to step up or down rotational speed and/or a "program" function by periodically changing the speed and/or direction of one or more of the wheels to help ensure fuller coverage of the pool surfaces.

These turbines, motors, gears and the like are virtually always located inside a pool cleaner body which rides on the wheels and, in the case of turbine-driven cleaners, includes a waterline connection for supply a water suction or pressure source to power the turbine. Routine maintenance of these pool cleaners will often require gaining access to the inside of the body. For example, debris will sometimes foul internal components of the cleaner, and removal of the debris will require opening of the body. Gaining access will often require the undoing of multiple small latches, and sometimes even the removal of one or more screws. This can make performing required maintenance difficult for some pool owners.

SUMMARY OF THE INVENTION

In view of the foregoing, it is an object of the present invention to provide an improved wheeled pool cleaner with a removable cover. According to an embodiment of the present invention, a pool cleaner includes a pool cleaner body and at least two wheels mounted to the pool cleaner body so as to be rotatable about a common wheel axis. The pool cleaner body includes an access cover selectively closing an access opening defined therein. A handle closure is mounted to the pool cleaner body so as to be rotatable about the common wheel axis independently of the at least two wheels. The handle closure is rotatable relative to the pool cleaner body so as to be movable between a closed position, in which the handle closure secures the access cover over the access opening, and an open position, in which the handle closure allows the access cover to be removed from the access opening.

According to an aspect of the present invention, an inner cover selectively covers a turbine and gears of the pool cleaner within the body. The inner cover is held in place via engagement with the access over.

According to a further aspect of the present invention, the wheels are attached to wheel wells on opposite side of the body, inner walls of the wheel wells being substantially solid such that an enclosed volume is formed therebetween in the pool cleaner body below the access cover to further inhibit the entrance of debris.

These and other objects, aspects and advantages of the present invention will be better appreciated in view of the drawings and following detailed description of preferred embodiments.

DETAILED DESCRIPTION OF PREFERRED EMBODIMENTS

Figure 1:
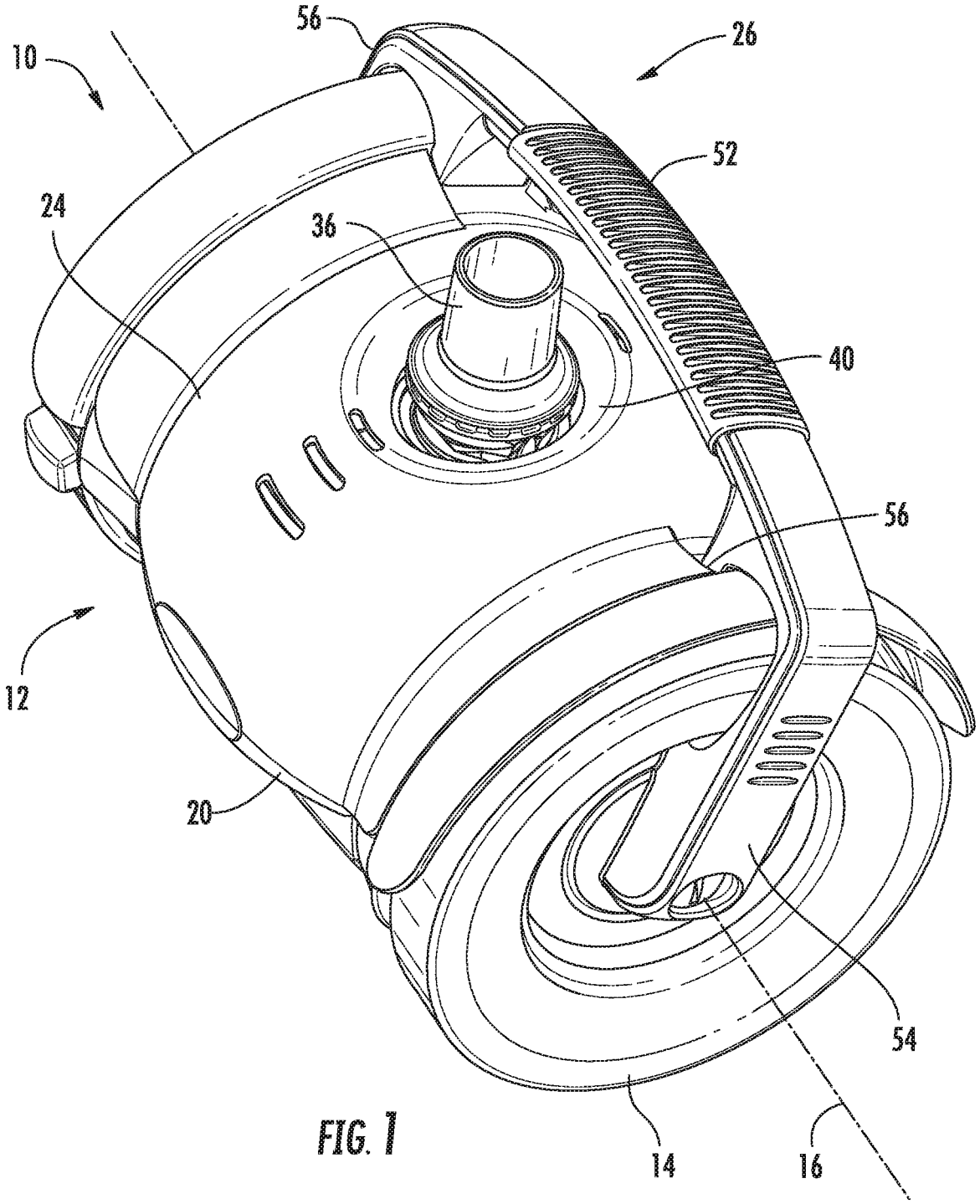
FIG. 1 is an upper perspective view of a pool cleaner according to an embodiment of the present invention, with a handle closure thereof in a closed position.
Figure 2:
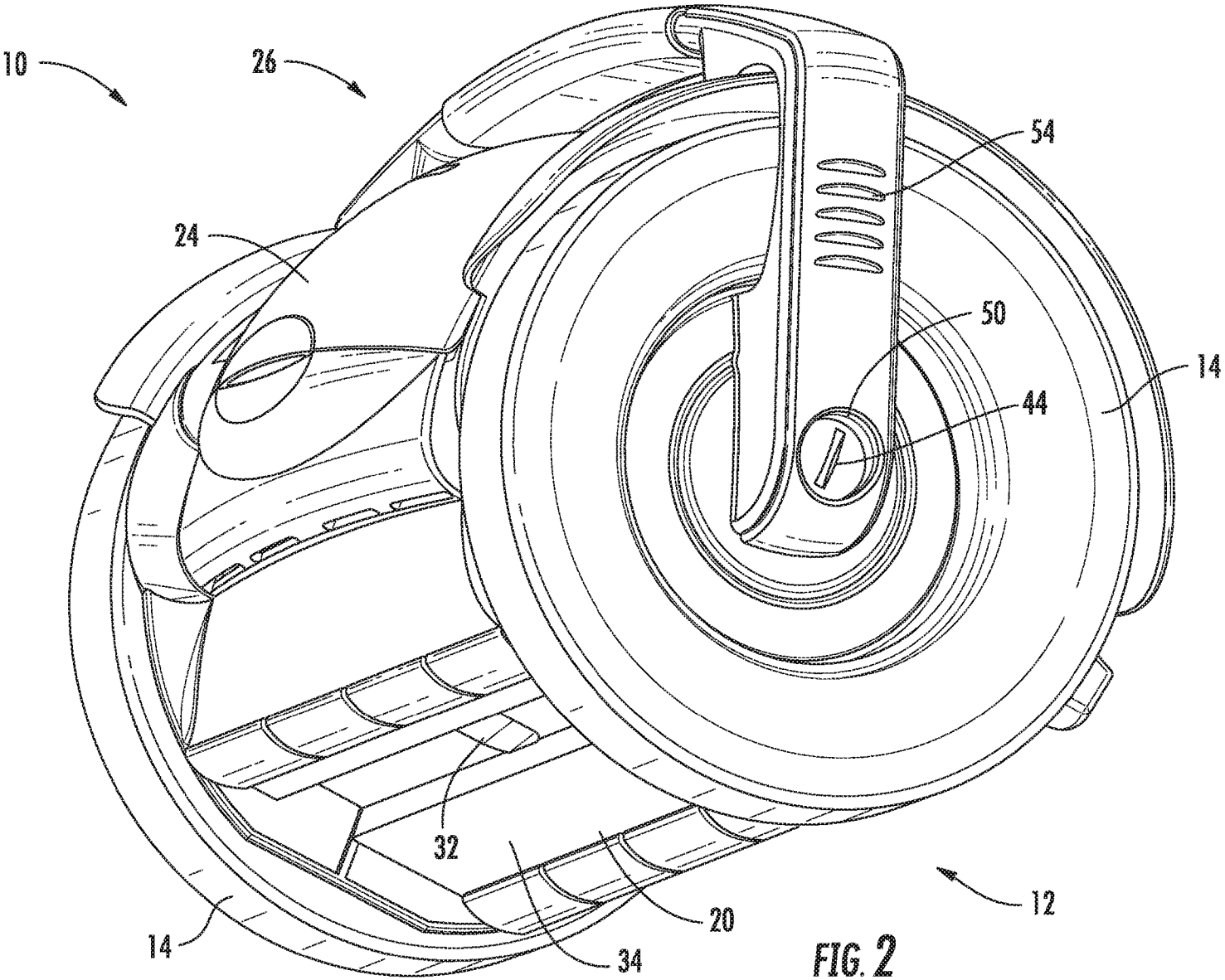
FIG. 2 is a lower perspective view of the pool cleaner of FIG. 1.
Figure 3:
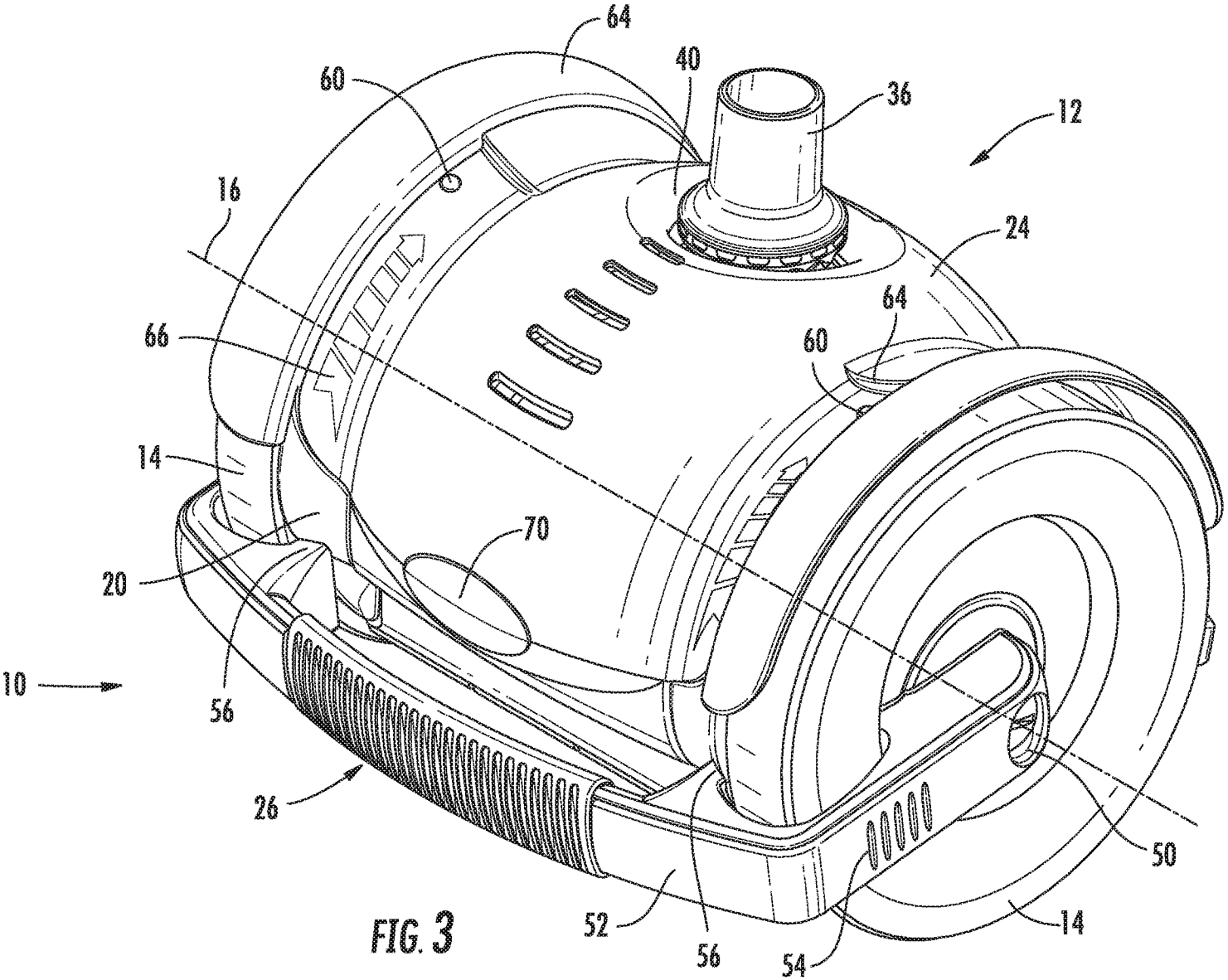
FIG. 3 is an upper perspective view of the pool cleaner of FIG. 1, with the handle closure in an open position.
Figure 4:
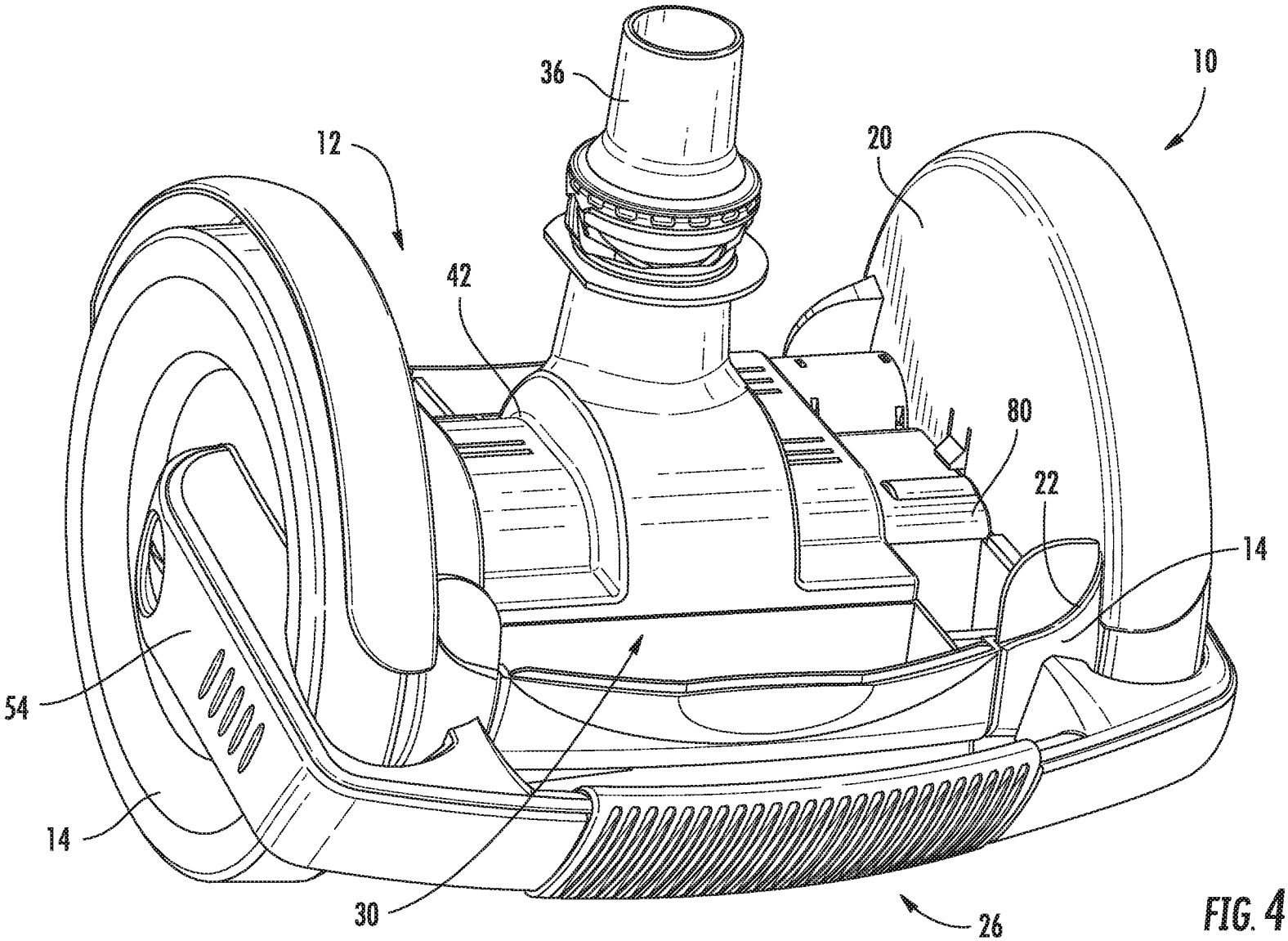
FIG. 4 is an upper perspective view of the pool cleaner of FIG. 1, with the handle closure in the open position and an access cover removed.

Referring to FIGS. 1-4, a pool cleaner 10 includes a body 12 to which a pair of wheels 14 are rotatably mounted about a common wheel axis 16. The body 12 includes a main body portion 20 in which an access opening 22 is defined and to which the wheels 14 are mounted. An access cover 24 selectively closes the access opening 22. A handle closure 26 is rotatably mounted to the main body portion 20 coaxially with the wheels 14. The handle closure 26 is rotatable between a closed position (as in FIG. 1), where the handle closure 26 secures the access cover 24 in place over the access opening 22, and an open position (as in FIG. 3), wherein the handle closure 26 is rotated to allow removal of the access cover 24 (as in FIG. 4).

The depicted pool cleaner 10 is suction-driven cleaner having only two wheels 14 between which the body 12 is suspended, although it will be appreciated that the present invention is not necessarily limited to use in connection with this specific type of cleaner. In the depicted cleaner 10, the wheels 14 are driven by a turbine 30 arranged inside the body 12 and powered by the flow of water between a suction opening 32 on a bottom surface 34 of the main body portion 20 and a suction connection 36 extending upwardly from the turbine 30 through a connection opening 40 in the access cover 24. The turbine 30 and associated gearing is covered by an inner cover 42, as will be explained in greater detail below.

Figure 5:
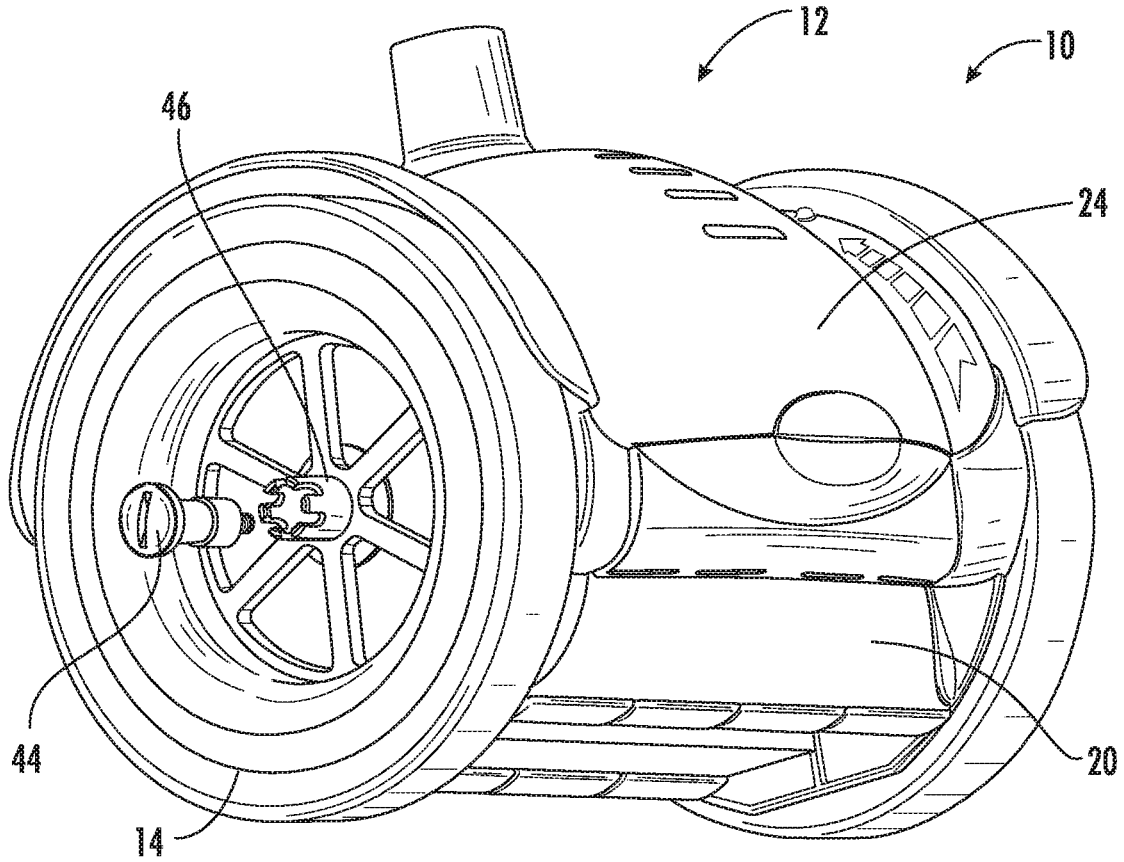
FIG. 5 is a partially exploded rear perspective view of the pool cleaner of FIG. 1, with the handle closure removed to show details.
Figure 6:
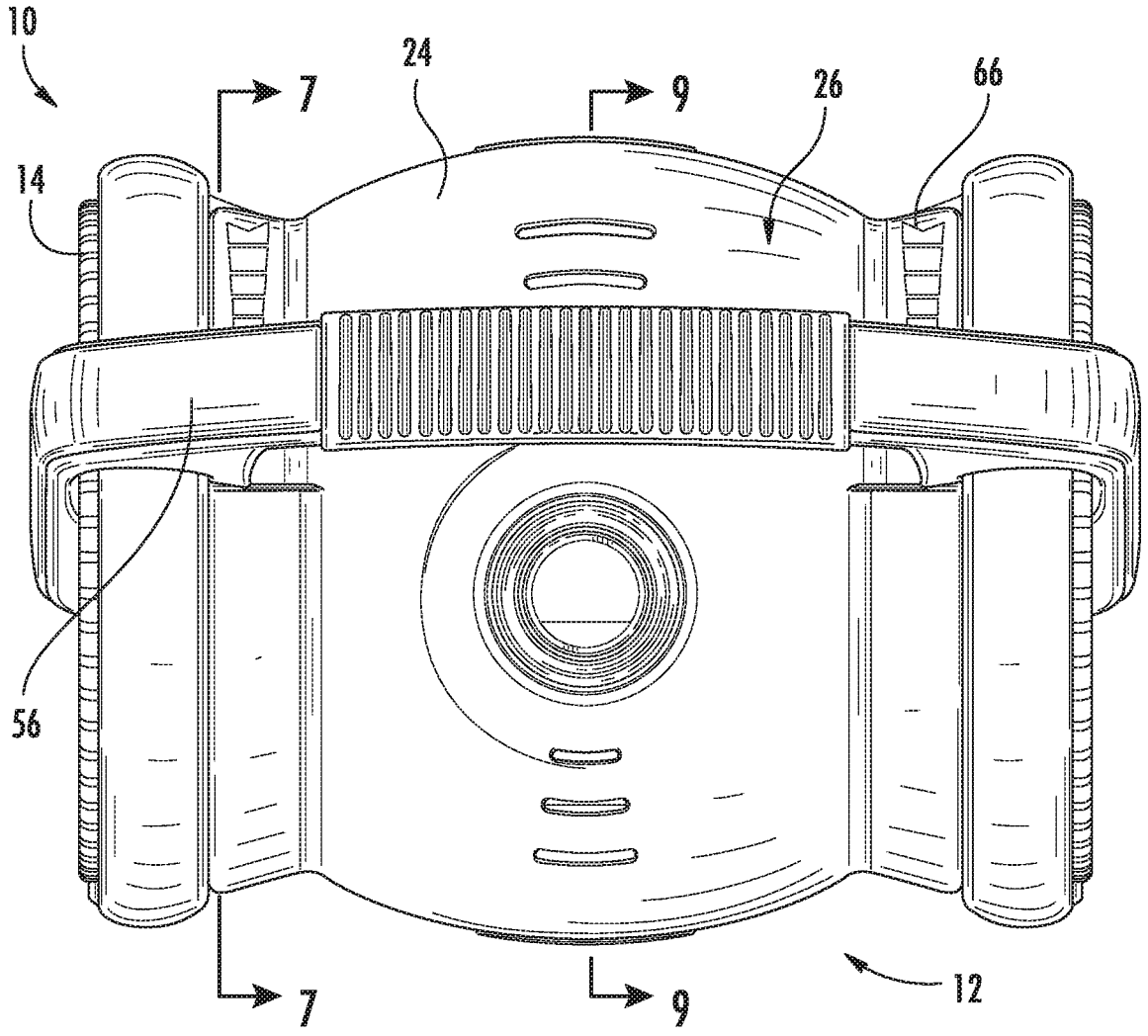
FIG. 6 is a top view of the pool cleaner of FIG. 1.

Referring also to FIG. 5, the wheels 14 and handle closure 26 are rotatably mounted to the main body portion 20 by axles 44, with both the wheels 14 and handle closure 26 being freely rotatable relative to the axles 44 and each other, such that movement of the wheels 14 will not result in unwanted movement of the handle closure 26. Hubs 46 on the wheels 14 extend into openings 50 at opposite ends of the handle closure 26, such that the wheels 14 and handle 26 can easily be placed onto the main body portion 20 together prior to affixation of the axles 44 from opposite sides. While the handle closure 26 advantageously rotatably attaches at opposite ends to both axles 44, it will be appreciated that a handle closure 26 attaching only on one side could also be employed.

The handle closure 26 preferably includes a lateral portion 52 which spans the body 12, and radial portions 54, which extend inwardly toward the wheel axis 16 from opposite ends of the lateral portion 52. The openings 50 are defined at distal ends of the radial portions 52. Cover engagement legs 56 extend downwardly from the lateral portion 52 inwardly of the radial portions 54. In the closed position, the legs 56 engage the access cover 24 to secure it in place over the access opening 22.

Figure 7:
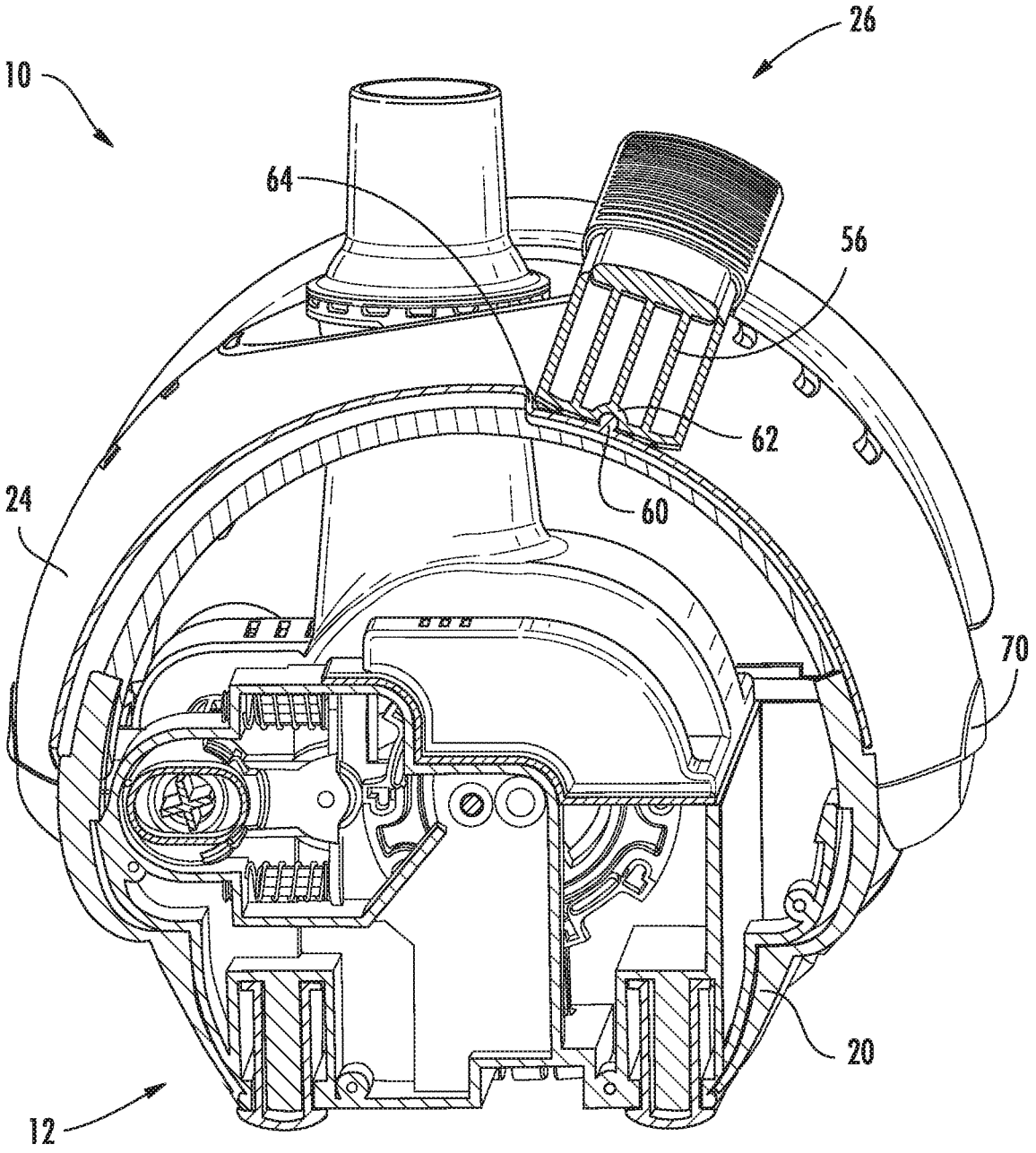
FIG. 7 is a sectional view taken along line 7-7 of FIG. 6.

Referring additionally to FIG. 7, to enhance retention of the access cover 24 with the handle closure 26 in the closed position, complementary surfaces 60, 62 are formed on the access cover 24 and lower ends of the cover engagement legs 56, respectively. With the complementary surfaces 60, 62 engaged, additional force must be engaged to rotate the handle closure 26 back toward the open position. Stop surfaces 64 are also formed on the access cover 24, which contact the engagement legs 56 in the closed position to prevent over-rotation of the handle closure 26 past the closed position. Rotation indicia 66 can also be provided on the access cover 24 to afford a visual prompt to rotate the handle closure 26 properly into the closed position. A protrusion 70 facilitates removal of the cover 24 with the handle closure 26 in the open position.

In use, to remove the access cover 24 and gain access to the interior of the body 12 via the opening 22, the handle closure 26 is urged out of the closed position with sufficient force to disengage the complementary surfaces 60, 62 and rotated to completely clear the cover 24. Once clear, the access cover 24 is simply lifted out of position over the suction connection 36, allowing access to the internal components for inspection or maintenance. When done, the access cover 24 is refitted into place and the handle closure 26 is rotated back into the closed position until the complementary surfaces 60, 62 reengage.

Figure 8:
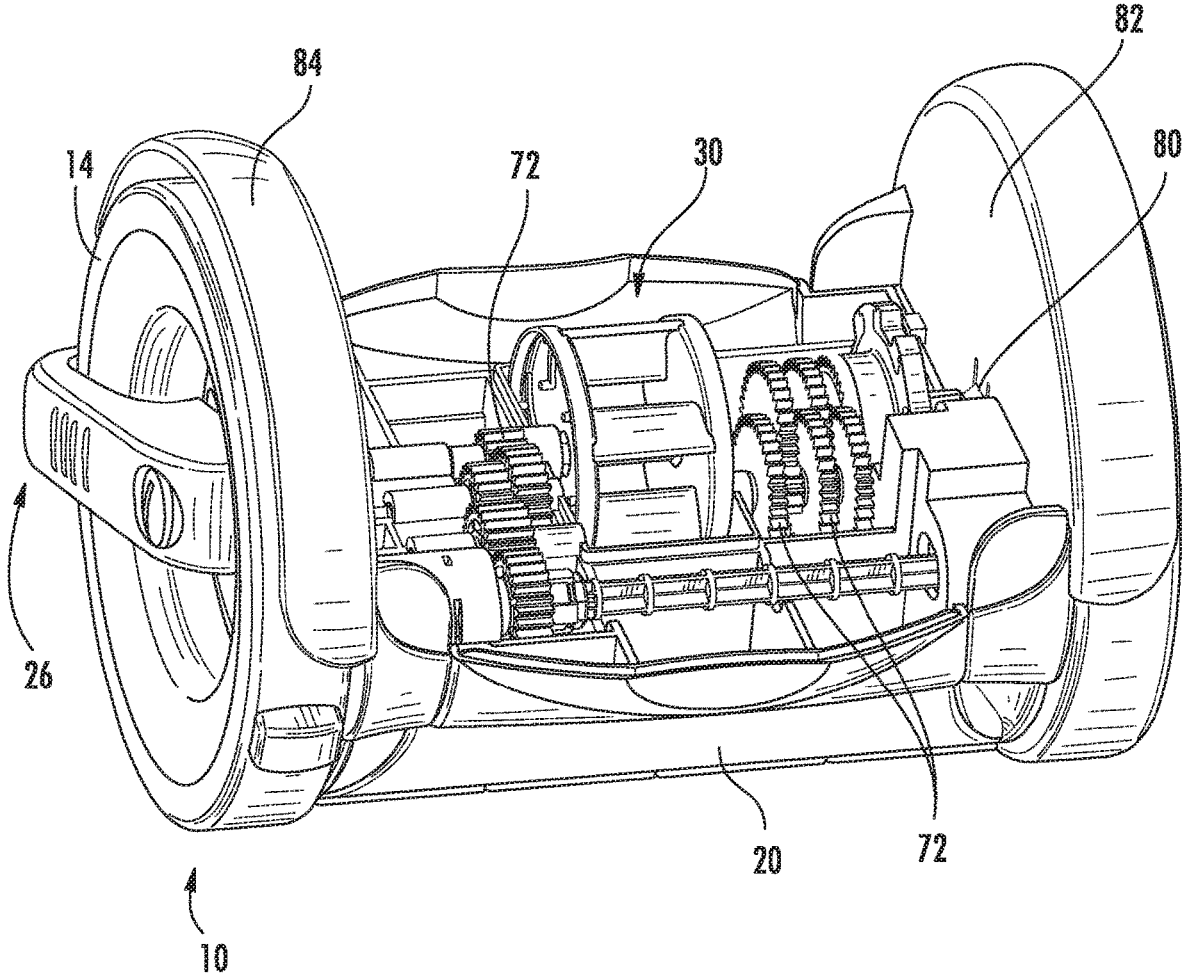
FIG. 8 is an upper perspective view of the pool cleaner of FIG. 1, with the handle closure in the open position, and the access cover and an internal shroud removed.
Figure 9:
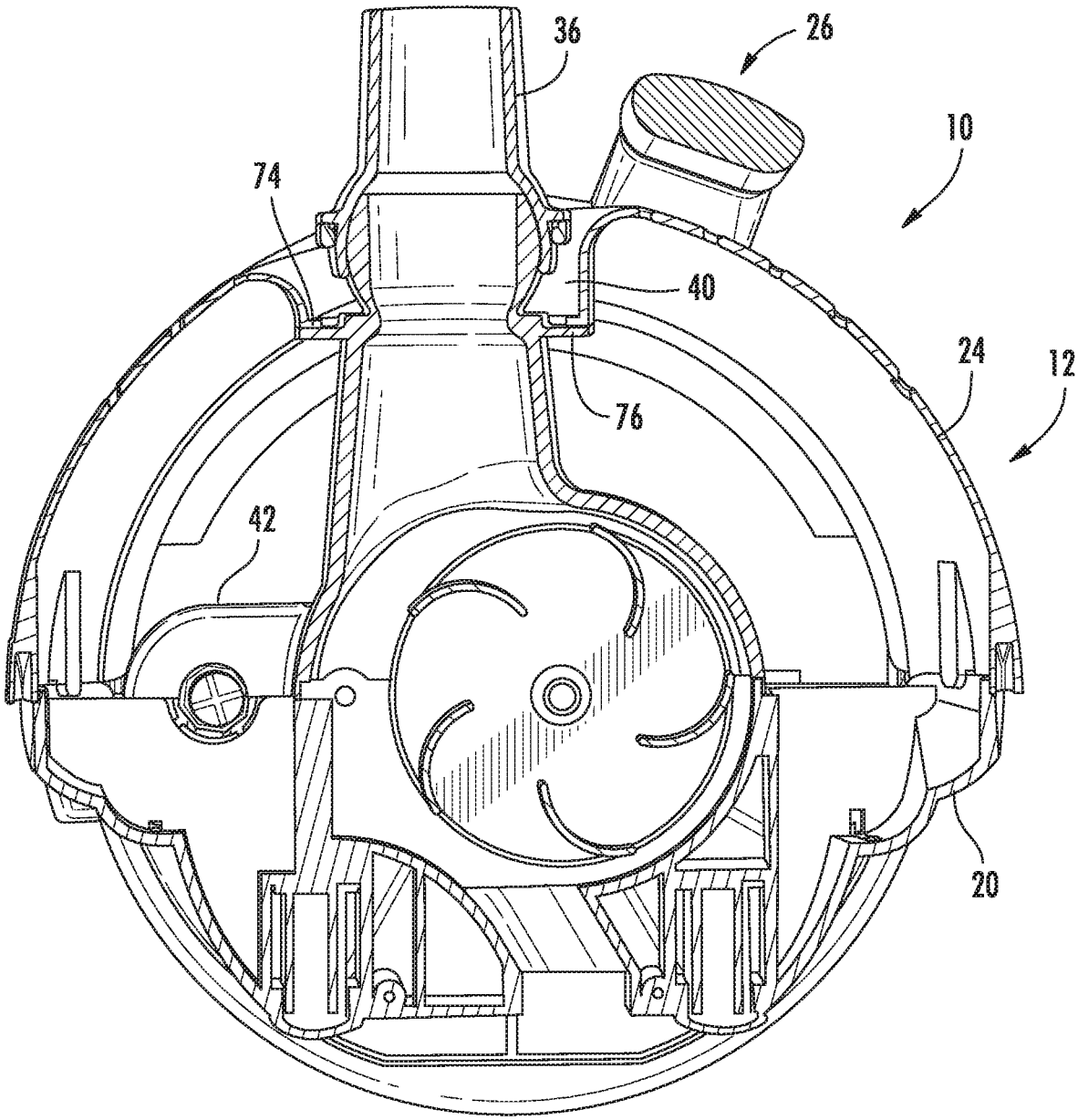
FIG. 9 is a sectional view taken along line 9-9 of FIG. 6.

Referring also to FIGS. 8 and 9, the inner cover 42 mates with the main body portion 20 to enclose the turbine 30 and gears 72. A lip 74 surrounding the connection opening 40 of the access cover 24 bears on a flange 76 formed around the inner cover 42 approaching the suction connection 36. With the access cover 24 held in place by the handle closure 26, the access cover 24 in turn ensures the inner cover 42 remains in place. If desired, this engagement with the access cover 24 could be the only fastening mechanism provided for the inner cover 42, such that operation of the handle closure 26 to the open position allows easy removal of both the access and inner covers 24, 42. Alternately, additional fasteners 80 (such as the depicted flexible stop tabs) could be provided to prevent removal of the inner cover 42 without an additional operation. In the depicted embodiment, the fasteners 80 are formed on inner walls 82 of wheel wells 84.

Notably, the configuration of the main body portion 20 with the inner cover 42 to closely enclose both the turbine 30 and the gears 72 can appreciably reduce the likelihood of waterborne debris from entering inside the body 12 and fouling moving internal components. The inner walls 82 are also substantially solid, further reducing the opportunity for debris introduction into the interior of the body 12. Such a configuration could advantageously be used in geared pool cleaners in which access covers are secured by means other than the depicted handle closure 26.

The foregoing is provided for illustrative and exemplary purposes; the present invention is not necessarily limited thereto. Rather, those skilled in the art will appreciate that various modifications, as well as adaptations to particular circumstances, are possible within the scope of the invention as herein shown and described and of the claimed appended hereto.

What is claimed is:

1. A pool cleaner comprising:

a pool cleaner body including an access cover selectively closing an access opening defined in the pool cleaner body;

at least two wheels mounted to the pool cleaner body so as to be rotatable about a common wheel axis; and a handle closure mounted to the pool cleaner body so as to be rotatable about the common wheel axis independently of the at least two wheels, the handle closure being rotatable relative to the pool cleaner body so as to be movable between a closed position, in which the handle closure secures the access cover over the access opening, and an open position, in which the handle closure allows the access cover to be removed from the access opening.

2. The pool cleaner of claim 1, wherein the handle closure in the closed position is the only impediment to removal of the access cover from the access opening.

3. The pool cleaner of claim 1, wherein the at least two wheels are the only two wheels mounted to the pool cleaner body.

4. The pool cleaner of claim 1, wherein at least one wheel of the at least two wheels is commonly mounted to a first axle with a first end of the handle closure.

5. The pool cleaner of claim 4, wherein the at least one wheel and the first end of the handle closure are both rotatable relative to the axle.

6. The pool cleaner of claim 5, wherein the at least one wheel includes a first hub extending into opening in the first end of the handle closure, the first axle extending through the hub and the opening into a side of the pool cleaner body.

7. The pool cleaner of claim 4, wherein the handle closure includes a lateral portion spanning at least a portion of the body and a first radial portion extending inwardly toward the wheel axis from a first end of the lateral portion, the at least one wheel being commonly mounted to the first axle with the first end of the handle closure at a distal end of the first radial portion.

8. The pool cleaner of claim 7, wherein a first cover engagement leg extends downwardly from the lateral portion inwardly of the first radial portion such that, in the closed position, the first cover engagement leg engages the access cover to secure the access cover in place over the access opening.

9. The pool cleaner of claim 8, wherein complementary surfaces are formed on the access cover and a lower end of the first cover engagement leg, respectively, the complementary surfaces engaging only when the handle closure is in the closed position, additional force being required to rotate the handle closure relative to the access cover with the complementary surfaces engaged.

10. The pool cleaner of claim 8, wherein a first stop surface is formed on the access cover, the first stop surface contacting the first cover engagement leg with the handle closure in the closed position to prevent over-rotation of the closure handle past the closed position.

11. The pool cleaner of claim 1, where the at least two wheels are, respectively, commonly mounted to first and second axles with first and second ends of the handle closure.

12. The pool cleaner of claim 1, further comprising a turbine arranged inside the pool cleaner body and selectively covered by an inner cover inside the access opening, wherein removal of the access cover with the handle closure in the open position allows access to the inner cover for removal.

13. The pool cleaner of claim 12, further comprising gears connected to the turbine inside the pool cleaner body, the gears also being selectively covered by the inner cover.

14. The pool cleaner body of claim 12, wherein a water source connection extends upwardly from the inner cover above the turbine, the water source connection extending through a connection opening in the access cover.

15. The pool cleaner body of claim 14, wherein a lip surrounding the connection opening bears on a flange formed on the inner cover proximate the water source connection, the lip engaging the flange when the access cover is held in place with the handle closure in the closed position, the engagement between the lip and flange ensuring the inner cover remains in place over the turbine.

16. The pool cleaner body of claim 15, wherein the engagement between the lip and flange, with the access cover held in place with the handle closure in the closed position, is the only impediment to removal of the inner cover.

17. The pool cleaner body of claim 15, wherein at least one additional fastener releasably holds the inner cover in place over the turbine.

18. The pool cleaner of claim 17, wherein the at least one additional fastener includes a stop tab formed on an inner wall of the pool cleaner body.

19. The pool cleaner of claim 12, wherein the at least two wheels are mounted to at least two wheel wells located at opposite sides of the pool cleaner body, inner walls of the wheel wells being substantially solid such that, with the access cover held in place with the handle closure in the closed position, an enclosed volume is formed within the pool cleaner body above the inner cover, below the access cover and between the inner walls of the wheel wells.

20. A pool cleaner comprising:

a pool cleaner body including an access cover selectively closing an access opening defined in the pool cleaner body;

at least two wheels mounted to the pool cleaner body so as to be rotatable about a common wheel axis;

a handle closure is mounted to the pool cleaner body so as to be rotatable about the common wheel axis independently of the at least two wheels, the handle closure being rotatable relative to the pool cleaner body so as to be movable between a closed position, in which the handle closure secures the access cover over the access opening, and an open position, in which the handle closure allows the access cover to be removed from the access opening;

a turbine arranged inside the pool cleaner body;

gears connected to the turbine inside the pool cleaner body; and an inner cover inside the access opening selectively covering the turbine and the gears;

wherein removal of the access cover allows removal of the inner cover.

21. The pool cleaner of claim 20, wherein the at least two wheels are mounted to at least two wheel wells located at opposite sides of the pool cleaner body, inner walls of the wheel wells being substantially solid such that, with the access cover in place, an enclosed volume is formed within the pool cleaner body above the inner cover, below the access cover and between the inner walls of the wheel wells.

22. The pool cleaner body of claim 20, wherein a water source connection extends upwardly from the inner cover above the turbine, the water source connection extending through a connection opening in the access cover.

23. The pool cleaner body of claim 22, wherein a lip surrounding the connection opening bears on a flange formed on the inner cover proximate the water source connection, the lip engaging the flange when the access cover is held in place with the handle closure in the closed position, the engagement between the lip and flange ensuring the inner cover remains in place over the turbine.

24. The pool cleaner body of claim 23, wherein the engagement between the lip and flange, with the access cover in place, is the only impediment to removal of the inner cover.

25. A pool cleaner comprising:

a pool cleaner body including an access cover selectively closing an access opening defined in the pool cleaner body;

at least two wheels mounted to the pool cleaner body so as to be rotatable about a common wheel axis;

a handle closure is mounted to the pool cleaner body so as to be rotatable about the common wheel axis independently of the at least two wheels, the handle closure being rotatable relative to the pool cleaner body so as to be movable between a closed position, in which the handle closure secures the access cover over the access opening, and an open position, in which the handle closure allows the access cover to be removed from the access opening;

a turbine arranged inside the pool cleaner body; and gears connected to the turbine inside the pool cleaner body;

wherein the at least two wheels are mounted to at least two wheel wells opposite sides of the pool cleaner body, inner walls of the wheel wells being substantially solid such that, with the access cover in place, an enclosed volume is formed within the pool cleaner body below the access cover and between the inner walls of the wheel wells.

26. The pool cleaner of claim 25, further comprising an inner cover inside the access opening selectively covering the turbine and the gears, the enclosed volume being further formed above the inner cover;

wherein removal of the access cover allows removal of the inner cover.

* * * * *